United States Patent [19]

Grushkin

[11] Patent Number: 4,480,023

[45] Date of Patent: Oct. 30, 1984

[54] RADIANT ASSIST PRESSURE FIXING PROCESS WITH POLYAMIDE TONER COMPOSITIONS

[75] Inventor: Bernard Grushkin, Pittsford, N.Y.

[73] Assignee: Xerox Corporation, Stamford, Conn.

[21] Appl. No.: 478,926

[22] Filed: Mar. 25, 1983

[51] Int. Cl.[3] ..... G03G 13/22

[52] U.S. Cl. ..... 430/124; 430/126; 118/641

[58] Field of Search ..... 430/97, 98, 124, 126; 118/642, 641

[56] References Cited

U.S. PATENT DOCUMENTS

| | | | |
|---|---|---|---|
| T875,005 | 12/1969 | Beyer et al. | 96/1 |
| 3,345,294 | 10/1967 | Cooper | 252/62.1 |
| 3,669,706 | 6/1972 | Sanders et al. | 430/126 |
| 3,698,314 | 10/1972 | Grier | 430/99 |
| 3,764,538 | 10/1973 | Shelffo | 538/62.1 |
| 3,893,761 | 7/1975 | Buchan et al. | 118/641 X |
| 3,898,171 | 8/1975 | Westdale | 538/62.1 |
| 4,256,818 | 3/1981 | Blossey et al. | 430/39 |

*Primary Examiner*—John D. Welsh
*Attorney, Agent, or Firm*—E. O. Palazzo

[57] ABSTRACT

This invention is generally directed to an improved process for fixing developed electrostatic images which comprises (1) forming an electostatic latent image on an imaging member, (2) developing the image with a toner composition comprised of polyamide toner resin particles, and pigment particles, (3) transferring the developed image to a substrate, and (4) sequentially subjecting the transferred image to a cold pressure fixing source, and a radiant energy fixing source.

10 Claims, No Drawings

RADIANT ASSIST PRESSURE FIXING PROCESS WITH POLYAMIDE TONER COMPOSITIONS

BACKGROUND OF THE INVENTION

This invention is generally directed to an improved process for fixing toner images, and more specifically the present invention is directed to a process for fixing developed polyamide toner images to suitable substrates by subjecting the image to cold pressure fixing, followed by radiant assist fixing. There is thus provided in accordance with the process of the present invention an improved method for fixing developed electrostatic latent images to appropriate substrates such as paper, which process allows the use of low pressures, and low radiant energy sources, thereby resulting in permanently fixed images possessing excellent solid area coverage.

The development of electrostatographic images, and in particular xerographic images with developer compositions containing toner materials is well known. In these systems an electrostatic latent image is formed on a photoconductive member, and the image is developed with a toner composition comprised of resin particles, and pigment particles. Subsequently, the developed image is transferred to a suitable substrate wherein fixing is generally accomplished by heat. Thus, final toner images are produced by heating the toner particles to a temperature at which these particles begin to flow in order to effect heat fusing of the particles to a support substrate such as paper. Generally, one disadvantage of the heat fixing process is that substantial energy is needed, and further the imaging device involved, such as a xerographic imaging machine, may in some instances require sufficient warm-up time in order to enable the toner image to be properly fused. An example of such a heat fusing system is described in U.S. Pat. No. 4,256,818, wherein there is disclosed the heating of the developed toner image for the purpose of causing the resins contained therein to at least partially melt and become adhered to the photoconductive imaging member, followed by the application of pressure to the toner with heating, such as the use of a heated roller. There is further disclosed in this patent a solvent vapor fusing process wherein the resin component of the toner is partially dissolved. However, it is known that prolonged heating of toner materials at high temperatures suffers from a number of defficiencies, for example, the paper to which the toned image is being fixed can be ignited or charred. Furthermore, the introduction of excessive amounts of heat into the xerographic imaging system can cause damage to other machine parts. While pressure fusing eliminates some of the disadvantages inherent in lengthy heat fusing cycles, pressure fusing alone has other disadvantages including the requirement for high pressures, and specially formulated toner compositions. Additionally, pressure fusing alone generally does not result in an image which is well fused to the paper substrate.

Cold pressure fusing processes nevertheless have a number of advantages primarily relating to the requirement for less energy as the toner compositions involved can be fixed, for example, at room temperature. Many prior art toner compositions selected for cold pressure fixing systems have been known to suffer from a number of deficiencies, for example, these toner compositions must usually be fused under high pressures, which pressures have a tendancy to severely disrupt the toner fusing characteristics of the compositions selected. This can result in images of low resolution, or no images whatsoever, and in some of these systems substantial image smearing has been noticed because of the high pressures required. While attempts have been made to improve toner compositions for cold pressure fixing systems, these compositions in many instances have a number of undesirable characteristics, including agglomeration of the toner particles at room temperature, insufficient flowability of these particles under high pressures, lack of adhesion of the toner particles to the support substrate, such as paper, unsuitable blocking temperatures, and an insufficient brittleness to allow preparation of such materials by, for example, known commercial jetting methods, or known fluid energy milling processes.

There is disclosed in U.S. Pat. No. 3,928,656, a pressure fixable toner comprised of a weakly cross-linked amorphous polymer, the cross-linked bonds of which are disrupted and/or broken by the application of pressure, and wherein the sufficiently soft polymeric material selected can be fixed by pressure. It is disclosed in this patent that the resinous materials include a weakly cross-linked amorphous polymer having a glass transition temperature of greater than about minus 20 degrees centigrade. Apparently the crosslinks of the polymer which are shear sensitive, can be temporarily disrupted, and are broken by the application of pressure resulting in a polymer which has the properties of an uncrosslinked polymer. When the pressure is released the polymer reverts to its crosslinked state. Accordingly, such a toner composition is capable of being fixed to a support medium in image configuration by the application of pressure, which pressure is generally provided by pressing the substrate material with the toner image contained thereon between a pair of polished metal rollers that are in contact with one another under a specified pressure. In general the metal rollers exert a pressure of form about 10 to about 600 pounds per linear inch, and preferably a pressure of from about 50 to about 400 pounds per linear inch, which pressure is calculated by dividing the total applied force by the length of the roll.

Additionally, disclosed in a co-pending application are pressure sensitive toner compositions comprised of a blend of two or more polymers selected from the group consisting of a blend of a polymer of polystyrene-co-stearylmethacrylate, and poly(octadecylvinylether-co-maleic anhydride); and polyisobutylmethacrylate polymers and poly(octadecylvinylether-co-maliec anhydride). The toner compositions described in this co-pending application exhibit sufficient flowability to allow proper development to occur, do not agglomerate or block at temperature of 120 degrees Faherenheit, and have sufficient adhesion properties to allow such compositions to be permanently bonded to suitable substrates such as plain bond paper. These toners when selected for the development of electrostatic latent images formed, for example, on selenium imaging members, were fused to plain bond paper with cold pressure rollers maintained at a pressure of from about 200 to 500 pounds per linear inch.

Nevertheless there continues to be a need for improved processes for fixing toner images to suitable substrates. Additionally, there continues to be a need for improved fixing methods wherein the resulting developed images can be fixed to suitable substrates with low energy inputs. Additionally, there continues to be a need for improved processes wherein various toner compositions can be fixed to suitable substrates by a combination of pressure fixing and radiant heat fixing steps. Moreover, there continues to be a need for an imaging process wherein the resulting images are of high resolution.

SUMMARY OF THE INVENTION

It is an object of the present invention to provide improved processes for fixing toner compositions to various substrates.

In another object of the present invention there is provided an improved method for fixing developed toner images to suitable substrates such as paper.

In yet a further object of the present invention there is provided an improved process for fixing developed toner images to various substrates by subjecting the images involved to cold pressure fixing followed by radiant assist fixing.

In still a further object of the present invention there is provided an improved process for fixing electrostatic latent images to suitable substrates, wherein the images have been developed by toner particles containing polyamide resins, polyester resins, and various polyblend resins, by subjecting the toner compositions containing these resins to a two-step fixing process, namely, a separate cold pressure fix fusing step, followed by subjecting the toner particles to a radiant energy source.

These and other objects of the present invention are accomplished by the provision of a process for fixing images which comprises initially subjecting images developed with toner compositions to cold pressure fixing step, and subsequently to radiant heat fixing. More specifically, the present invention is directed to a process for fixing developed electrostatic latent images resulting from electrostatically charging a photoconductive imaging member in the dark, exposing the member to a light pattern so as to result in the formation thereon of an electrostatic latent image, developing the charged image by applying thereto a toner composition comprised of polyamide resin particles and pigment particles, transferring the developed image to a suitable substrate such as paper, and subsequently fixing the image thereto by sequentially subjecting the toner particles to cold pressure fixing source, and a radiant heat fixing source.

The improved process of the present invention thus involves in one embodiment the following steps:

1. Forming an electrostatic latent image on a photoresponsive device, such as a photoconductor.

2. Developing the formed image with toner particles comprised of polyamide resin particles, and pigment particles.

3. Transferring the developed image to a suitable substrate such as paper.

4. Fixing the image by sequentially subjecting the image to cold pressure fixing rollers, at a pressure of from about 100 lineal pounds per inch, to about 500 lineal pounds per inch, and a radiant heat fixing source generating energy of from about 5 Jolues/inch$^2$ to about 15 Joules/inch$^2$.

By cold pressure fixing, in accordance with the process of the present invention is meant contacting the developed toner image with pressure, such as that generated by known pressure rolls, with the pressure ranging from about 100 pounds per linear inch to about 500 pounds per linear inch, and preferably from about 150 pounds per linear inch to about 300 pounds per linear inch. Examples of known pressure rollers include those commercially available from Hatachi Metals, namely, a unit consisting of three rolls containing highly polished top and bottom rolls with dimensions of 1.34 inches in diameter, and 8.98 inches in length, and a backup roll of 1.1 inches in diameter, and 8.98 inches in length. The pressure on these rolls can be adjusted so as to range from about 200 pounds per linear inch, to 460 pounds per linear inch.

Immediately subsequent to the cold pressure fusing sequence, the substrate containing the developed image is directed to a radiant fusing fixture, substantially similar to known fixtures incorporated in various commercial xerographic imaging devices, such as the Xerox Corporation 3450 imaging machine. As a source of energy for accomplishing the heat fixing sequence there can be selected a lamp, which generates about 1150 watts of energy. Moreover, the speed at which the substrate is directed at the pressure rollers and radiant fixing device can be adjusted so as to range from about 5 inches/sec (15.3 Jolues/inches$^2$) to 15 inches/sec (5 Jolues/inch$^2$).

Illustrative examples of toner resins selected for the process of the present invention include those that can be subjected to a combination of cold pressure fixing, and radiant heat fixing, while simultaneously allowing the production of permanent fused images of high image quality. Specific illustrative examples of resins selected include polyamide resins, such as those commercially available as Emerez, 1590, 1592, 1552, 1540; Versamid 712, 744, commercially available from Henkel Corporation, Crosby 1803, 1805, 1833, 1889, polyamide resins commercially available from Crosby Chemically, Inc., polyesters such as Poly(hexamethylene sebacate, Poly(hexamethylene azelate), Poly(hexamethylene adipate), and Poly(tetramethylene suberate) available from Polyscience, Inc., polyblends of resinous particles, including polyblends of polyamide/polyethylene waxes, polyethylene/ethylene-vinyl acetate copolymers, and polyamide/rosin esters of polymeric rosin esters. The polyamide resins are believed to have a number average molecular weight of from about 1,500 to about 5,000, and a glass transition temperature of from about 45 degrees centigrade to 65 degrees centigrade, and result from the reaction of a diamine, such as diethylene triamine, with a dibasic acid, such as adipic acid.

Pigment particles selected for the toner compositions that may be subjected to the fixing process of the present invention include carbon black, nigrosine, magnitites, iron oxide mixtures, mixtures thereof, and the like. Also, there can be included in the toner compositions of the present invention as a substitute for the above illustrated pigment particles, various colored powdered pigments including known magenta, cyan, red, blue, and green pigments. Illustrative examples of these pigments include phthalocyanines, such as copper phthalocyanine, vanadyl phthalocyanine, polychloro copper phthalocyanine, Litho Scarlet Red, Hansa Yellow, and the like.

The resin particles are generally present in the toner compositions in an amount ranging from about 30 percent by weight to about 95 percent by weight, and preferably in an amount of from about 70 percent by weight to about 90 percent by weight, with the pigment particles being present in an amount ranging from about 5 percent by weight to about 70 percent by weight, and preferably in an amount of from about 10 percent by weight to about 20 percent by weight.

The image to be developed and subsequently fixed in accordance with the process of the present invention can be formed on various electrostatic surfaces capable of retaining charge, including conventional photoconductors such as amorphous selenium, alloys of selenium, including selenium tellurium, selenic arsenic, selenium arsenic tellurium, selenium arsenic antimoney, with amorphous selenium being preferred. Additionally, the electrostatic latent image can be generated on organic photoreceptors wherein generally a negative charge resides on the surface, and accordingly thus there is usually included in the toner composition a charge enhancing additive for the purpose of imparting a positive charge to the toner resin particles. Illustrative examples of organic photoreceptors include polyvinylcarbozole, polyvinylcarbzole-trinitrofluorenone charge transfer complexes, metal phthalocyanines, metal free phthalocyanines devices. Examples of useful layered photoresponsive devices include those comprised of a transport layer and a photogenerating layer, reference U.S. Pat. No. 4,265,990, the disclosure of which is totally incorporated herein by reference. Specific examples of photogenerating layers include trigonal selenium, metal phthalocyanines, metal free phthalocyanines, and vanadyl phthalocyanine, while examples of a transport layer include N,N'-diphenyl-N,N'-Bis(3-methyl phenyl) 1,1'-biphenyl-4,4'-diamine dispersed in a polycarbonate resinous binder composition.

As appropriate charge enhancing additives for imparting a positive charge to the toner resin particles there can be selected various known charge enhancing additives, including alkyl pyridinium halides, such as cetyl pyridinium chloride, organic sulfate or organic sulfonate compositions, including stearyl dimethyl benzyl ammonium para-toluene sulfonate, stearyl dimethyl benzyl ammonium methyl sulfate, stearyl dimethyl phenethyl ammonium methyl sulfate, stearyl dimethyl phenethyl ammonium para-toluene sulfonate, cetyl diethyl benzyl ammonium methyl sulfate, cetyl dimethyl benzyl ammonium methylsulfonate, cetyl pyridinium tetrafluoroborate, various known quaternary ammonium compounds, and the like.

Examples of suitable carrier materials that can be selected for formulating a developer composition containing the toner compositions of the present invention include methylmethacrylate, glass, steel, nickel, iron, iron ferrites, silicon dioxides, and the like, with metallic carriers, especially magnetic metallic carriers being preferred. These carriers can be used with or without a coating, with the coatings generally being comprised of polymer resins, such as polyvinylidine fluoride polymers, and methyl terpolymers. Many of the typical carriers that can be used are described, for example, in U.S. Pat. Nos. 3,618,522; 3,533,835, and 3,526,533. Also, nickel berry carriers as described in U.S. Pat. Nos. 3,847,604 and 3,767,598 can be selected, these carriers being nodular carrier beads of nickel characterized by surfaces of reoccurring recessions and protrusions providing particles with a relatively large external area. The diameter of the coated carrier particles is from about 50 to about 1,000 microns, thus allowing the carriers to possess sufficient density and inertia to avoid adherence to the electrostatic images during the development process.

The developing compositions can be prepared by mixing and blending followed by mechanical attrition of the toner resin particles with the pigment particles, and then subsequently mixing the resulting toner composition, from about 1 part to about 10 parts, with about 200 parts by weight of carrier particles.

The following examples are being supplied to further define the species of the present invention and being noted that these examples are intended to illustrate and not limit the scope of the present invention. Parts and percentages are by weight unless otherwise indicated.

EXAMPLE I

There was prepared a toner composition containing 90 percent by weight of the polyamide resin Emerz 1590, and 10 percent by weight of Regal 330 carbon black, by melt blending followed by mechanical attrition. This toner composition, one part by weight was then mixed with 100 parts by weight of carrier particles consisting of a steel core coated with a terpolymer of styrene, methylmethacrylate, and vinyl triethoxy silane.

Subsequently, a positively charged electrostatic latent image was formed on a photoreceptor comprised of amorphous selenium, and thereafter this image was developed by contacting it with the above prepared developer composition. Thereafter, the developed image was transferred to paper by charging the paper positively with a corotron device.

The paper containing the developed image was then contacted with a three roller pressure fixing unit, commercially available from Hatachi, the top and bottom rollers having dimensions of 1.34 inches in diameter, and 8.8 inches long, while the middle backup roll was 1.1 inches in diameter, and 8.98 inches in length. These rollers were maintained at a pressure of 460 pounds per linear inch by the adjustment of set screws contained on the frame of the fixture. Subsequently, the paper with the partially fixed image was contacted with a radiant fusing fixture containing a 15 inch Sylvania lamp, capable of delivering 1150 watts of energy at 105 volts, which lamp was incorporated into a Xerox Corporation 3450 radiant fuser sub-assembly. The paper was transported by by a movable belt, through the radiant fusing fixture at a speed of 6.4 inches/sec, thus causing 12 Joules/inches$^2$ of energy to be available for fixing.

The resulting fixed image was then subjected to the following Taber paper abrasion test, and subsequent visual observation indicated that the fused images did not smear.

The Taber abrasion test involves the evaluation of images on a Taber abraser available from Testing Machines, Incorporated. This test was, for example, accomplished by determining the loss in optical density of the fixed images after ten cycles using CS-10 abrasive wheels under a 1 kilogram load. The ratio of optical densities, $^d$final/$^d$initial, as determined from the slope of a plot of $^d$final vs. $^d$initial was used as a single value measure of the fix. A low or zero valve indicates undesirable fix or no fix.

The above imaging and fixing procedure was repeated wherein other developed images were fixed with the radiant fusing fixture containing a 15 inch Sylvania lamp, capable of delivering 1,150 watts of energy at 105 volts, this fixing being accomplished at processing speeds of 7, 7.7, 8.5, 9.6, 11, and 12.8 inches/sec, providing fused images over a range of energy inputs of from about 6 to about 12 Joules/inches$^2$. Visual observation of these fused images subsequent to subjecting them to the paper abrasion test indicated that the images did not smear, and were of high desirable resolution.

Additionally, images developed with the above prepared toner composition were contacted with the Hatachi three roller pressure fixing unit, maintained at a pressure of 460 pounds, and fixing of the image did not result, that is, a fixing vaue of 0 was calculated when the images were subjected to the Taber abrasion test. In contrast, fixing values of 0.1, 0.4, and 0.75, were obtained when images developed with the above prepared toner composition were subjected to the Hatachi three roller pressure fixing unit, maintained at a pressure of 460 pounds per lineal inch, followed by sequentially subjecting the images to the 15 inch Sylvania lamp wherein 8, 9, and 11 Joules/inches$^2$ of radiant energy were available for fixing.

EXAMPLE II

A second toner composition was prepared by repeating the procedure of Example I with the exception that 90 percent by weight of the polyamide resin Versamid 744, commercially available from Henkel Corporation, was blended with 10 percent by weight of the Regal 330 carbon black. A developer composition was then formulated by mixing one part by weight of this toner composition with 100 parts by weight of carrier particles consisting of a steel core coated with a terpolymer of styrene, methyl methacrylate, and vinyl triethoxy silane.

Electrostatic latent images were then formed, developed, and transferred by repeating the procedure of Example I. Subsequently, these images were sequentially subjected to pressure fixing with the Hatachi three roller pressure fixing unit, and radiant fusing with the 15 inch Sylvania lamp, by repeating the procedure of Example I. These images were then subjected to the Taber paper abrasion test of Example I, and there resulted in all instances a desirable fixing value of 0.6 with 5 Joules/inches$^2$ of radiant energy. In contrast, when images were generated, developed, transferred, and then fixed with the Hatachi three roller pressure fixing unit by repeating the procedure of Example I, which images were not radiant fused, there resulted a fixing value of 0.12, when these images were subjected to the Taber abrasion test of Example I.

Thereafter, an image was formed, developed, transferred, and fixed by repeating the procedure of Example I with the exception that the Hatachi pressure rollers were maintained at a pressure of 250 pounds/lineal inch and radiant fusing was accomplished with 5 Joules/inches$^2$ of radiant energy. Subsequent to subjecting this image to the Taper paper abrasion test these resulted a fixing value of 0.5. In contrast, when an image was generated, developed, transferred, and fixed, by repeating the procedure of Example I, with the exception that the image was not subjected to the radiant fusing fixture, but rather was fixed by contact only with the Hatachi three roller pressure fixing unit, there resulted a fixing value of 0.4.

EXAMPLE III

There was prepared by melt blending followed by mechanical attrition a toner composition containing 60 percent by weight of polyethylene commercially available from Petrolite Corporation, as BARECO 2000, 27 percent by weight of a polymer of polyvinyl acetate, commercially available from Allied Corporation, as AC400, 10 percent by weight of Regal 330 carbon black, and 2.5 percent by weight of cetyl pyridinium chloride. The resulting toner composition was then attrited, resulting in toner particles having an average particle size diameter of 15.5 microns. A developer composition was then prepared by mixing two parts by weight of this toner composition with 100 parts by weight of carrier particles consisting of a steel core partially coated with a polymer of polyvinyldene fluoride, commercially available from E. I. duPont Corporation.

The resulting developer was then used to develop an electrostatic latent image formed on a negatively charged organic layered photoreceptor prepared as described in U.S. Pat. No. 4,265,990, and containing an aluminum substrate, overcoated with a photogenerating layer of vanadyl phthalocyanine, which in turn was overcoated with a charge transport layer containing N,N'-diphenyl-N,N'-Bis(3-methyl phenyl) 1,1'-biphenyl-4,4'-diamine, dispersed in a polycarbonate resinous binder. The resulting developed image was transferred to a paper substrate and fused by first pressure fixing, then radiant fusing in accordance with the procedure of Example I. When fixed at a pressure of 250 pounds per linear inch, and an energy of 5 Joules/in$^2$, the fixing value as determined by the Taber abrasion test was 0.65.

EXAMPLE IV

A toner composition was prepared by repeating the procedure of Example III, with the exception that the resulting composition contained 25 percent by weight of the polyethylene wax, BARECO 2000, 20 percent by weight of the polyvinyl acetate polymer, AC400, and 55 percent by weight of Mapico Black, a magnetite which contains a mixture of iron oxides, commercially available from Cities Service Corporation. The resulting toner composition was then attrited in accordance with the process of Example III, while simultaneously adding thereto 0.2 percent by weight of carbon black with vigorous agitation.

The resulting toner composition was then used to develop with a magnetic brush device, an elecrostatic latent image formed on a positively charged selenium photoreceptor. Thereafter, this image was transferred to a paper substrate, and fixed by sequentially subjecting the image to the Hatachi pressure fixing unit, and the radiant fusing fixture containing a 15 inche Sylvania lamp, in accordance with Example I, with the exception that rollers were maintained at a pressure of 250 pounds/linear inch, rather than 460 pounds/linear inch, and the radiant energy available for fixing was 7 Joules/inches$^2$. Visual observation of the image indicated that it did not smear under strong finger pressure. Further, the resulting developed image was subjected to the Taper paper abrasion test, by repeating the procedure of Example I, and there resulted a fixed value of 0.7.

Other modifications of the present invention may occur to those skilled in the art based upon a reading of the present disclosure, and these are intended to be included within the scope of the present invention.

I claim:

1. An improved process for fixing developed electrostatic images consisting essentially of (1) forming an electrostatic latent image on an imaging member, (2) developing the image with a toner composition comprised of polyamide toner resin particles, and pigment particles, (3) transferring the developed image to a substrate, and (4) sequentially subjecting the transferred image to a cold pressure fixing source, and a radiant energy fixing source.

2. An improved process in accordance with claim 1 wherein the polyamide resin in the reation product of a diamine, and a dibasic acid of a number average molecular weight of from about 1,500, to about 5,000, and a glass transition temperature of from about 45 degrees centigrade to about 65 degrees centigrade.

3. An improved process in accordance with claim 1 wherein the toner resin particles are comprised of a polymer of polyvinyl acetate, and a polyethylene wax.

4. An improved process in accordance with claim 3, wherein the polyethylene wax is present in an amount of about 60 percent by weight, and the polyvinyl acetate polymer is present in an amount of about 27 percent by weight.

5. An improved process of imaging in accordance with claim 1, wherein the cold pressure fixing is accomplished at a pressure ranging from about 100 pounds/-lineal inch to about 500 pounds/lineal inch.

6. An improved process in accordance with claim 1 wherein radiant fuxing is accomplished at from about 5 Joules/inches$^2$ to about 12 Joules/inches$^2$.

7. An improved process in accordance with claim 1 wherein the pigment particles are carbon black, or magnetite.

8. An improved process in accordance with claim 1 wherein there is further included in the developer composition a charge enhancing additive for the purpose of imparting a positive charge to the toner particles.

9. An improved process in accordance with claim 8 wherein the charge enhancing additive is cetyl pyridinium chloride.

10. An improved process in accordance with claim 1 wherein the radiant energy fixing step is accomplished with a radiant heat lamp.

* * * * *